United States Patent [19]

Kukes et al.

[11] Patent Number: 4,578,180

[45] Date of Patent: Mar. 25, 1986

[54] HYDROFINING PROCESS FOR HYDROCARBON CONTAINING FEED STREAMS

[75] Inventors: Simon G. Kukes; Robert J. Hogan; Daniel M. Coombs; Daniel J. Strope, all of Bartlesville, Okla.

[73] Assignee: Phillips Petroleum Company, Bartlesville, Okla.

[21] Appl. No.: 596,983

[22] Filed: Apr. 5, 1984

[51] Int. Cl.[4] ..... C10G 45/12; C10G 47/12; C10G 47/16

[52] U.S. Cl. ..... 208/110; 208/111; 208/112; 208/216 R; 208/251 H; 208/254 H

[58] Field of Search ..... 208/108, 112, 216 R, 208/251 H, 110, 111, 254 H

[56] References Cited

U.S. PATENT DOCUMENTS

| | | | |
|---|---|---|---|
| 3,161,585 | 12/1964 | Gleim et al. | 208/264 |
| 3,196,104 | 7/1966 | Gleim et al. | 208/264 |
| 3,331,769 | 7/1967 | Gatsis | 208/210 |
| 4,132,631 | 1/1979 | Nametkin et al. | 208/236 |
| 4,134,825 | 1/1979 | Bearden, Jr. et al. | 208/112 |
| 4,244,839 | 1/1981 | Aldridge et al. | 502/211 |
| 4,285,804 | 8/1981 | Jacquin et al. | 208/108 |

OTHER PUBLICATIONS

Alper, et al., "Use of Molybdenum Carbonyl . . . ", *Fuel,* v. 61 (Nov.), p. 1164.

Alper, et al., "Removal of Sulfur from Fuels . . . ", *Fuel,* v. 59 (Nov., 1980), p. 670.

*Primary Examiner*—John Doll
*Assistant Examiner*—O. Chaudhuri
*Attorney, Agent, or Firm*—French and Doescher

[57] ABSTRACT

At least one decomposable compound selected from the group consisting of dimanganese decacarbonyl and chromium hexacarbonyl is mixed with a hydrocarbon-containing feed stream. The hydrocarbon containing feed stream containing such decomposable compound is then contacted in a hydrofining process with a catalyst composition comprising a support selected from the group consisting of alumina, silica and silica-alumina and a promoter comprising at least one metal selected from Group VIB, Group VIIB and Group VIII of the Periodic Table. The introduction of the decomposable compound may be commenced when the catalyst is new, partially deactivated or spent with a beneficial result occurring in each case.

22 Claims, No Drawings

HYDROFINING PROCESS FOR HYDROCARBON CONTAINING FEED STREAMS

This invention relates to a hydrofining process for hydrocarbon-containing feed streams. In one aspect, this invention relates to a process for removing metals from a hydrocarbon-containing feed stream. In another aspect, this invention relates to a process for removing sulfur or nitrogen from a hydrocarbon-containing feed stream. In still another aspect, this invention relates to a process for removing potentially cokeable components from a hydrocarbon-containing feed stream. In still another aspect, this invention relates to a process for reducing the amount of heavies in a hydrocarbon-containing feed stream.

It is well known that crude oil as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalysts employed in processes such as catalytic cracking, hydrogenation or hydrodesulfurization.

The presence of other components such as sulfur and nitrogen is also considered detrimental to the processability of a hydrocarbon-containing feed stream. Also, hydrocarbon-containing feed streams may contain components (referred to as Ramsbottom carbon residue) which are easily converted to coke in processes such as catalytic cracking, hydrogenation of hydrodesulfurization. It is thus desirable to remove components such as sulfur and nitrogen and components which have a tendency to produce coke.

It is also desirable to reduce the amount of heavies in the heavier fractions such as the topped crude and residuum. As used herein the term heavies refers to the fraction having a boiling range higher than about 1000° F. This reduction results in the production of lighter components which are of higher value and which are more easily processed.

It is thus an object of this invention to provide a process to remove components such as metals, sulfur, nitrogen and Ramsbottom carbon residue from a hydrocarbon-containing feed stream and to reduce the amount of heavies in the hydrocarbon-containing feed stream (one or all of the described removals and reduction may be accomplished in such process, which is generally refered to as a hydrofining process, depending on the components contained in the hydrocarbon-containing feed stream). Such removal or reduction provides substantial benefits in the subsequent processing of the hydrocarbon-containing feed stream.

In accordance with the present invention, a hydrocarbon-containing feed stream, which also contains metals, such as vanadium, nickel, iron, sulfur, nitrogen and/or Ramsbottom carbon residue, is contacted with a solid catalyst composition comprising alumina, silica or silica-alumina. The catalyst composition also contains at least one metal selected from Group VIB, Group VIIB, and Group VIII of the Periodic Table, in the oxide or sulfide form. At least one decomposable compound selected from the group consisting of dimanganese decacarbonyl and chromium hexacarbonyl is mixed with the hydrocarbon-containing feed stream prior to contacting the hydrocarbon-containing feed stream with the catalyst composition. The hydrocarbon-containing feed stream, which also contains dimanganese decacarbonyl and/or chromium hexacarbonyl is contacted with the catalyst composition in the presence of hydrogen under suitable hydrofining conditions. After being contacted with the catalyst composition, the hydrocarbon-containing feed stream will contain a significantly reduced concentration of metals, sulfur, nitrogen and Ramsbottom carbon residue as well as a reduced amount of heavy hydrocarbon components. Removal of these components from the hydrocarbon-containing feed stream in this manner provides an improved processability of the hydrocarbon-containing feed stream in processes such as catalytic cracking, hydrogenation or further hydrodesulfurization. Use of the dimanganese decacarbonyl and/or chromium hexacarbonyl results in improved removal of metals, primarily vanadium and nickel.

The dimanganese decacarbonyl and/or chromium hexacarbonyl may be added when the catalyst composition is fresh or at any suitable time thereafter. As used herein, the term "fresh catalyst" refers to a catalyst which is new or which has been reactivated by known techniques. The activity of fresh catalyst will generally decline as a function of time if all conditions are maintained constant. It is believed that the introduction of the dimanganese decacarbonyl and/or chromium hexacarbonyl will slow the rate of decline from the time of introduction and in some cases will dramatically improve the activity of an at least partially spent or deactivated catalyst from the time of introduction.

For economic reasons it is sometimes desirable to practice the hydrofining process without the addition of dimanganese decacarbonyl and/or chromium hexacarbonyl until the catalyst activity declines below an acceptable level. In some cases, the activity of the catalyst is maintained constant by increasing the process temperature. The dimanganese decacarbonyl and/or chromium hexacarbonyl is added after the activity of the catalyst has dropped to an unacceptable level and the temperature cannot be raised further without adverse consequences. It is believed that the addition of dimanganese decacarbonyl and/or chromium hexacarbonyl at this point will result in a dramatic increase in catalyst activity based on the results set forth in Example IV.

Other objects and advantages of the invention will be apparent from the foregoing brief description of the invention and the appended claims as well as the detailed description of the invention which follows.

The catalyst composition used in the hydrofining process to remove metals, sulfur, nitrogen and Ramsbottom carbon residue and to reduce the concentration of heavies comprises a support and a promoter. The support comprises alumina, silica or silica-alumina. Suitable supports are believed to be $Al_2O_3$, $SiO_2$, $Al_2O_3$—$SiO_2$, $Al_2O_3$—$TiO_2$, $Al_2O_3$—$BPO_4$, $Al_2O_3$—$AlPO_4$, $Al_2O_3$—$Zr_3(PO_4)_4$, $Al_2O_3$—$SnO_2$ and $Al_2O_3$—ZnO. Of these supports, $Al_2O_3$ is particularly preferred.

The promoter comprises at least one metal selected from the group consisting of the metals of Group VIB, Group VIIB, and Group VIII of the Periodic Table. The promoter will generally be present in the catalyst composition in the form of an oxide or sulfide. Particularly suitable promoters are iron, cobalt, nickel, tungsten, molybdenum, chromium, manganese, vanadium and platinum. Of these promoters, cobalt, nickel, molybdenum and tungsten are the most preferred. A particularly preferred catalyst composition is $Al_2O_3$ promoted by CoO and $MoO_3$ or promoted by CoO, NiO and $MoO_3$.

Generally, such catalysts are commercially available. The concentration of cobalt oxide in such catalysts is typically in the range of about 0.5 weight percent to about 10 weight percent based on the weight of the total catalyst composition. The concentration of molybdenum oxide is generally in the range of about 2 weight percent to about 25 weight percent based on the weight of the total catalyst composition. The concentration of nickel oxide in such catalysts is typically in the range of about 0.3 weight percent to about 10 weight percent based on the weight of the total catalyst composition. Pertinent properties of four commercial catalysts which are believed to be suitable are set forth in Table I.

TABLE I

| Catalyst | CoO (Wt. %) | MoO (Wt. %) | NiO (Wt. %) | Bulk Density* (g/cc) | Surface Area ($M^2/g$) |
|---|---|---|---|---|---|
| Shell 344 | 2.99 | 14.42 | — | 0.79 | 186 |
| Katalco 477 | 3.3 | 14.0 | — | .64 | 236 |
| KF - 165 | 4.6 | 13.9 | — | .76 | 274 |
| Commerical Catalyst D Harshaw Chemical Company | 0.92 | 7.3 | 0.53 | — | 178 |

*Measured on 20/40 mesh particles, compacted.

The catalyst composition can have any suitable surface area and pore volume. In general, the surface area will be in the range of about 2 to about 400 $m^2/g$, preferably about 100 to about 300 $m^2/g$, while the pore volume will be in the range of about 0.1 to about 4.0 cc/g, preferably about 0.3 to about 1.5 cc/g.

Presulfiding of the catalyst is preferred before the catalyst is initially used. Many presulfiding procedures are known and any conventional presulfiding procedure can be used. A preferred presulfiding procedure is the following two step procedure.

The catalyst is first treated with a mixture of hydrogen sulfide in hydrogen at a temperature in the range of about 175° C. to about 225° C., preferably 205° C. The temperature in the catalyst composition will rise during this first presulfiding step and the first presulfiding step is continued until the temperature rise in the catalyst has substantially stopped or until hydrogen sulfide is detected in the effluent flowing from the reactor. The mixture of hydrogen sulfide and hydrogen preferably contains in the range of about 5 to about 20 percent hydrogen sulfide, preferably about 10 percent hydrogen sulfide.

The second step in the preferred presulfiding process consists of repeating the first step at a temperature in the range of about 350° C. to about 400° C., preferably about 370° C., for about 2–3 hours. It is noted that other mixtures containing hydrogen sulfide may be utilized to presulfide the catalyst. Also the use of hydrogen sulfide is not required. In a commercial operation, it is common to utilize a light naphtha containing sulfur to presulfide the catalyst.

As has been previously stated, the present invention may be practiced when the catalyst is fresh or the addition of dimanganese decacarbonyl and/or chromium hexacarbonyl may be commenced when the catalyst has been partially deactivated. The addition of dimanganese decacarbonyl and/or chromium hexacarbonyl may be delayed until the catalyst is considered spent.

In general, a "spent catalyst" refers to a catalyst which does not have sufficient activity to produce a product which will meet specifications, such as maximum permissible metals content, under available refinery conditions. For metals removal, a catalyst which removes less than about 50% of the metals contained in the feed is generally considered spent.

A spent catalyst is also sometimes defined in terms of metals loading (nickel + vanadium). The metals loading which can be tolerated by different catalyst varies but a catalyst whose weight has increased at least about 15% due to metals (nickel + vanadium) can generally be considered a spent catalyst.

Any suitable hydrocarbon-containing feed stream may be hydrofined using the above described catalyst composition in accordance with the present invention. Suitable hydrocarbon-containing feed streams include petroleum products, coal, pyrolyzates, products from extraction and/or liquefaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy topped crudes and residuum and other materials which are generally regarded as too heavy to be distilled. These materials will generally contain the highest concentrations of metals, sulfur, nitrogen and Ramsbottom carbon residues.

It is believed that the concentration of any metal in the hydrocarbon-containing feed stream can be reduced using the above described catalyst composition in accordance with the present invention. However, the present invention is particularly applicable to the removal of vanadium, nickel and iron.

The sulfur which can be removed using the above described catalyst composition in accordance with the present invention will generally be contained in organic sulfur compounds. Examples of such organic sulfur compounds include sulfides, disulfides, mercaptans, thiophenes, benzylthiophenes, debenzylthiophenes, and the like.

The nitrogen which can be removed using the above described catalyst composition in accordance with the present invention will also generally be contained in organic nitrogen compounds. Examples of such organic nitrogen compounds include amines, diamines, pyridines, quinolines, porphyrins, benzoquinolines and the like.

While the above described catalyst composition is effective for removing some metals, sulfur, nitrogen and Ramsbottom carbon residue, the removal of metals can be significantly improved in accordance with the present invention by introducing dimanganese decacarbonyl and/or chromium hexacarbonyl into the hydrocarbon-containing feed stream prior to contacting the hydrocarbon containing feed stream with the catalyst composition. As has been previously stated, the introduction of dimanganese decacarbonyl and/or chromium hexacarbonyl may be commenced when the catalyst is new, partially deactivated or spent with a beneficial result occurring in each case.

Dimanganese decacarbonyl and chromium hexacarbonyl may be used alone or in combination as an additive. Dimanganese decacarbonyl is the preferred additive as will be demonstrated more fully in the Examples.

Any suitable concentration of the additive may be added to the hydrocarbon-containing feed stream. In general, a sufficient quantity of the additive will be added to the hydrocarbon-containing feed stream to result in a concentration of metal (manganese and/or chromium) in the range of about 1 to about 60 ppm and more preferably in the range of about 2 to about 30 ppm.

High concentrations such as about 100 ppm and above should be avoided to prevent plugging of the reactor. It is noted that one of the particular advantages of the present invention is the very small concentrations of metal which result in a significant improvement. This substantially improves the economic viability of the process.

After the additive has been added to the hydrocarbon-containing feed stream for a period of time, it is believed that only periodic introduction of the additive is required to maintain the efficiency of the process.

The dimanganese decacarbonyl and/or chromium hexacarbonyl may be combined with the hydrocarbon-containing feed stream in any suitable manner. The dimanganese decacarbonyl and/or chromium hexacarbonyl may be mixed with the hydrocarbon-containing feed stream as a solid or liquid or may be dissolved in a suitable solvent (preferably an oil) prior to introduction into the hydrocarbon-containing feed stream. Any suitable mixing time may be used. However, it is believed that simply injecting dimanganese decacarbonyl and/or chromium hexacarbonyl into the hydrocarbon-containing feed stream is sufficient. No special mixing equipment or mixing period are required.

The pressure and temperature at which dimanganese decacarbonyl and/or chromium hexacarbonyl is introduced into the hydrocarbon-containing feed stream is not thought to be critical. However, a temperature below 450° C. is recommended.

The hydrofining process can be carried out by means of any apparatus whereby there is achieved a contact of the catalyst composition with the hydrocarbon containing feed stream and hydrogen under suitable hydrofining conditions. The hydrofining process is in no way limited to the use of a particular apparatus. The hydrofining process can be carried out using a fixed catalyst bed, fluidized catalyst bed or a moving catalyst bed. Presently preferred is a fixed catalyst bed.

Any suitable reaction time between the catalyst composition and the hydrocarbon-containing feed stream may be utilized. In general, the reaction time will range from about 0.1 hours to about 10 hours. Preferably, the reaction time will range from about 0.3 to about 5 hours. Thus, the flow rate of the hydrocarbon containing feed stream should be such that the time required for the passage of the mixture through the reactor (residence time) will preferably be in the range of about 0.3 to about 5 hours. This generally requires a liquid hourly space velocity (LHSV) in the range of about 0.10 to about 10 cc of oil per cc of catalyst per hour, preferably from about 0.2 to about 3.0 cc/cc/hr.

The hydrofining process can be carried out at any suitable temperature. The temperature will generally be in the range of about 150° C. to about 550° C. and will preferably be in the range of about 340° to about 440° C. Higher temperatures do improve the removal of metals but temperatures should not be utilized which will have adverse effects on the hydrocarbon-containing feed stream, such as coking, and also economic considerations must be taken into account. Lower temperatures can generally be used for lighter feeds.

Any suitable hydrogen pressure may be utilized in the hydrofining process. The reaction pressure will generally be in the range of about atmospheric to about 10,000 psig. Preferably, the pressure will be in the range of about 500 to about 3,000 psig. Higher pressures tend to reduce coke formation but operation at high pressure may have adverse economic consequences.

Any suitable quantity of hydrogen can be added to the hydrofining process. The quantity of hydrogen used to contact the hydrocarbon-containing feed stock will generally be in the range of about 100 to about 20,000 standard cubic feet per barrel of the hydrocarbon-containing feed stream and will more preferably be in the range of about 1,000 to about 6,000 standard cubic feet per barrel of the hydrocarbon-containing feed stream.

In general, the catalyst composition is utilized until a satisfactory level of metals removal fails to be achieved which is believed to result from the coating of the catalyst composition with the metals being removed. It is possible to remove the metals from the catalyst composition by certain leaching procedures but these procedures are expensive and it is generally contemplated that once the removal of metals falls below a desired level, the used catalyst will simply be replaced by a fresh catalyst.

The time in which the catalyst composition will maintain its activity for removal of metals will depend upon the metals concentration in the hydrocarbon-containing feed streams being treated. It is believed that the catalyst composition may be used for a period of time long enough to accumulate 10–200 weight percent of metals, mostly Ni, V, and Fe, based on the weight of the catalyst composition, from oils.

The following examples are presented in further illustration of the invention.

EXAMPLE I

In this example, the automated experimental setup for inventigating the hydrofining of heavy oils in accordance with the present invention is described. Oil, with or without a dissolved decomposable metal carbonyl, was pumped downward through an induction tube into a trickle bed reactor, 28.5 inches long and 0.75 inches in diameter. The oil pump used was a Whitey Model LP 10 (a reciprocating pump with a diaphragm-sealed head; marketed by Whitey Corp., Highland Heights, Ohio). The oil induction tube extended into a catalyst bed (located about 3.5 inches below the reactor top) comprising a top layer of 40 cc of low surface area α-alumina (Alundum; surface area less than 1 $m^2$/gram; marketed by Norton Chemical Process Products, Akron, Ohio), a middle layer of 33.3 cc of a hydrofining catalyst mixed with 85 cc of 36 grit Alundum and a bottom layer of 25 cc of α-alumina.

The hydrofining catalyst used was a fresh, commercial, promoted desulfurization catalyst (referred to as catalyst D in table I) marketed by Harshaw Chemical Company, Beachwood, Ohio. The catalyst had an $A_2O_3$ support having a surface area of 178 $m^2$/g (determined by BET method using $N_2$ gas), a medium pore diameter of 140 Å and at total pore volume of 0.682 cc/g (both determined by mercury porosimetry in accordance with the procedure described by American Instrument Company, Silver Springs, Md., catalog number 5-7125-13. The catalyst contained 0.92 weight-% Co (as cobalt oxide), 0.53 weight-% Ni (as nickel oxide); 7.3 weight-% Mo (as molybdenum oxide).

The catalyst was presulfided as follows. A heated tube reactor was filled with an 4 inch high bottom layer of Alundum, a 17–18 inch high middle layer of catalyst D, and a 6 inch top layer of Alundum. The reactor was purged with nitrogen and then the catalyst was heated for one hour in a hydrogen stream to about 400° F. While the reactor temperature was maintained at about 400° F., the catalyst was exposed to a mixture of hydrogen (0.46 scfm) and hydrogen sulfide (0.049 scfm) for about 14 hours. The catalyst was then heated for about one hour in the mixture of hydrogen and hydrogen sulfide to a temperature of about 700° F. The reactor temperature was then maintained at 700° F. for 14 hours while the catalyst continued to be exposed to the mixture of hydrogen and hydrogen sulfide. The catalyst was then allowed to cool to ambient temperature conditions in the mixture of hydrogen and hydrogen sulfide and was finally purged with nitrogen.

Hydrogen gas was introduced into the reactor through a tube that concentrically surrounded the oil induction tube but extended only as far as the reactor top. The reactor was heated with a Thermcraft (Winston-Salem, N.C.) Model 211 3-zone furnace. The reactor temperature was measured in the catalyst bed at three different locations by three separate thermocouples embedded in an axial thermocouple well (0.25 inch outer diameter). The liquid product oil was generally collected every day for analysis. The hydrogen gas was vented. Vanadium and nickel contents were determined by plasma emission analysis; sulfur content was measured by X-ray fluorescence spectometry; Ramsbottom carbon residue was determined in accordance with ASTM D524; pentane insolubles were measured in accordance with ASTM D893 and nitrogen content was measured in accordance with ASTM 03228.

The dimanganese decacarbonyl and chromium hexacarbonyl were mixed in the feed by adding a desired amount to the oil and then shaking and stirring the mixture. The resulting mixture was supplied through the oil induction tube to the reactor when desired.

EXAMPLE II

Desalted, topped (400° F.+) Hondo Californian heavy crude (density at 38.5° C.: 0.963 g/cc) was hydrotreated in accordance with the procedure described in Example I. The liquid hourly space velocity (LHSV) of the oil was about 1.5 cc/cc catalyst/hr, the hydrogen feed rate was about 4,800 standard cubic feed (SCF) of hydrogen per barrel of oil, the temperature range was about 750° F., and the pressure was about 2250 psig.

The additives used were $Mo(CO)_6$ (marketed by Aldrich Chemical Company, Milwaukee, Wis.; used in run 2); $Cr(CO)_6$ (marketed by Pressure Chemical Company, Pittsburgh, PA; used in run 3); and $Mn_2(CO)_{10}$ (marketed by Pressure Chemical Company; used in run 4). Pertinent process conditions of two control runs and two invention runs are summarized in Table II.

TABLE II

| Run | Days on Stream | LHSV | Temp (°F.) | PPM in Feed: Added Metal | PPM in Feed: Ni | PPM in Feed: V | PPM in Feed: Ni + V | PPM in Product: Ni | PPM in Product: V | PPM in Product: Ni + V | % Removal of (Ni + V) |
|---|---|---|---|---|---|---|---|---|---|---|---|
| 1 | | | | | | | | | | | |
| (Control) | 1 | 1.58 | 750 | 0 | 103 | 248 | 351 | 30 | 54 | 84 | 76 |
| | 2 | 1.51 | 750 | 0 | 103 | 248 | 351 | 34 | 59 | 93 | 74 |
| No Additive | 3 | 1.51 | 750 | 0 | 103 | 248 | 351 | 35 | 62 | 97 | 72 |
| | 4 | 1.51 | 750 | 0 | 103 | 248 | 351 | 36 | 63 | 99 | 72 |
| | 5 | 1.49 | 750 | 0 | 103 | 248 | 351 | 35 | 64 | 99 | 72 |
| | 6 | 1.55 | 750 | 0 | 103 | 248 | 351 | 28 | 60 | 88 | 75 |
| | 7 | 1.53 | 750 | 0 | 103 | 248 | 351 | 38 | 71 | 109 | 69 |
| | 9 | 1.68 | 750 | 0 | 103 | 248 | 351 | 40 | 64 | 104 | 70 |
| | 10 | 1.53 | 750 | 0 | 103 | 248 | 351 | 20 | 26 | 46 | 87[4] |
| | 17 | 1.61 | 750 | 0 | 103 | 248 | 351 | 49 | 98 | 147 | 58[4] |
| | 18 | 1.53 | 750 | 0 | 103 | 248 | 351 | 40 | 75 | 115 | 67 |
| | 19 | 1.53 | 750 | 0 | 103 | 248 | 351 | 40 | 73 | 113 | 68 |
| | 20 | 1.57 | 750 | 0 | 103 | 248 | 351 | 44 | 75 | 119 | 66 |
| | 21 | 1.45 | 750 | 0 | 103 | 248 | 351 | 41 | 68 | 109 | 69 |
| | 22 | 1.49 | 750 | 0 | 103 | 248 | 351 | 41 | 60 | 101 | 71 |
| | 24 | 1.47 | 750 | 0 | 103 | 248 | 351 | 42 | 69 | 111 | 68 |
| 2 | | | | | | | | | | | |
| (Control) | 1 | 1.56 | 750 | 20[1] | 103 | 248 | 351 | 22 | 38 | 60 | 83 |
| | 1.5 | 1.56 | 750 | 20 | 103 | 248 | 351 | 25 | 42 | 67 | 81 |
| $Mo(CO)_6$ | 2.5 | 1.46 | 750 | 20 | 103 | 248 | 351 | 28 | 42 | 70 | 80 |
| Added | 3.5 | 1.47 | 750 | 20 | 103 | 248 | 351 | 19 | 35 | 54 | 85 |
| | 6 | 1.56 | 750 | 20 | 103 | 248 | 351 | 29 | 38 | 67 | 81 |
| | 7 | 1.55 | 750 | 20 | 103 | 248 | 351 | 25 | 25 | 50 | 86 |
| | 8 | 1.50 | 750 | 20 | 103 | 248 | 351 | 27 | 35 | 62 | 82 |
| | 9 | 1.53 | 750 | 20 | 103 | 248 | 351 | 27 | 35 | 62 | 82 |
| | 10 | 1.47 | 750 | 20 | 103 | 248 | 351 | 32 | 35 | 67 | 81 |
| | 11 | 1.47 | 751 | 20 | 103 | 248 | 351 | 25 | 35 | 60 | 83 |
| | 12 | 1.42 | 750 | 20 | 103 | 248 | 351 | 27 | 34 | 61 | 83 |
| | 13 | 1.47 | 750 | 20 | 103 | 248 | 351 | 31 | 35 | 66 | 81 |
| | 14 | 1.56 | 750 | 20 | 103 | 248 | 351 | 36 | 52 | 88 | 75 |
| | 15 | 1.56 | 750 | 20 | 103 | 248 | 351 | 47 | 68 | 115 | 67[4] |
| 3 | | | | | | | | | | | |
| (Invention) | 3 | 1.56 | 744 | 20[2] | 108 | 250 | 358 | 31 | 51 | 82 | 77 |
| | 4 | 1.56 | 750 | 20 | 108 | 250 | 358 | 34 | 56 | 90 | 75 |
| with | 4 | 1.59 | 750 | 20 | 108 | 250 | 358 | 35 | 59 | 94 | 74 |
| $Cr(CO)_6$ | 5 | 1.61 | 750 | 20 | 108 | 250 | 358 | 37 | 63 | 100 | 72 |
| | 6 | 1.36 | 750 | 20 | 108 | 250 | 358 | 30 | 40 | 70 | 80 |
| | 7 | 1.43 | 750 | 20 | 108 | 250 | 358 | 32 | 48 | 80 | 78 |

TABLE II-continued

| Run | Days on Stream | LHSV | Temp (°F.) | PPM in Feed: Added Metal | Ni | V | Ni + V | PPM in Product: Ni | V | Ni + V | % Removal of (Ni + V) |
|---|---|---|---|---|---|---|---|---|---|---|---|
| | 8 | — | 750 | 20 | 108 | 250 | 358 | 31 | 50 | 81 | 77 |
| | 9 | — | 750 | 20 | 108 | 250 | 358 | 30 | 48 | 78 | 78 |
| | 10 | — | 750 | 20 | 108 | 250 | 358 | 31 | 54 | 85 | 76 |
| | 11 | 1.41 | 749 | 20 | 108 | 250 | 358 | 35 | 67 | 102 | 72 |
| | 12 | — | 750 | 20 | 108 | 250 | 358 | 33 | 59 | 92 | 74 |
| | 13 | 1.62 | 750 | 20 | 103 | 239 | 342 | 36 | 62 | 98 | 71 |
| | 14 | — | 750 | 20 | 103 | 239 | 342 | 36 | 78 | 124 | 64 |
| | 15 | — | 750 | 20 | 103 | 239 | 342 | 41 | 71 | 112 | 67 |
| 4 (Invention) with $Mn_2(C)_{10}$ | 1 | | 750 | 18[3] | 109 | 243 | 352 | 36 | 45 | 81 | 77 |
| | 2 | | 750 | 18 | 109 | 243 | 352 | 38 | 48 | 86 | 76 |
| | 3 | | 750 | 18 | 109 | 243 | 352 | 31 | 42 | 73 | 79 |
| | 4 | | 750 | 18 | 109 | 243 | 352 | 29 | 46 | 75 | 79 |
| | 5 | | 750 | 18 | 109 | 243 | 352 | 28 | 40 | 68 | 81 |
| | 6 | | 750 | 18 | 109 | 243 | 352 | 30 | 44 | 74 | 79 |

[1]ppm Mo, added as $Mo(CO)_6$
[2]ppm Cr, added as $Cr(CO)_6$
[3]ppm Mn, added as $Mn2(CO)_{10}$
[4]Results believed to be erroneous.

Data in Table II show that $Cr(CO)_6$ and $Mn_2(CO)_{10}$ were effective in enhancing the removal of (Ni+V) from the heavy oil (compare runs 3 and 4 with run 1). The preferred demetallizing agent, $Mn_2(CO)_{10}$, was nearly as effective as $Mo(CO)_6$, a prior art demetallizing agent.

Data on the removal of other impurities in the heavy oil in the four runs of this example are summarized in Table III. The listed weight percentages of sulfur, Ramsbottom carbon residue, pentane insolubles and nitrogen in the product were the lowest and highest values measured during the entire run times (run 1: about 24 days; run 2: about 15 days; run 3: about 15 days; run 4: about 6 days).

TABLE III

| | Run 1 (Control) | Run 2 (Control) | Run 3 (Invention) | Run 4 (Invention) |
|---|---|---|---|---|
| Wt % in Feed: | | | | |
| Sulfur | 5.6 | 5.6 | 5.5 | 5.4 |
| Carbon Residue | 9.9 | 9.9 | 9.9 | 9.6 |
| Pentane Insolubles | 13.4 | 13.4 | 13.4 | 14.7 |
| Nitrogen | 0.70 | 0.70 | 0.73 | 0.72 |
| Wt % in Product | | | | |
| Sulfur | 1.5–3.0 | 1.3–2.0 | 1.5–2.6 | 1.1–1.6 |
| Carbon Residue | 6.6–7.6 | 5.0–5.9 | 5.8–7.1 | 5.4–5.9 |
| Pentane Insolubles | 4.9–6.3 | 4.3–6.7 | 5.1 | 3.9 |
| Nitrogen | 0.60–0.68 | 0.55–0.63 | 0.58–0.64 | 0.49–0.51 |
| Sulfur | 46–73 | 64–77 | 53–73 | 70–80 |
| Carbon Residue | 23–33 | 40–49 | 28–41 | 39–46 |
| Pentane Insolubles | 53–63 | 50–68 | 62 | 73 |
| Nitrogen | 3–14 | 10–21 | 12–21 | 29–32 |

Data in Table III show that, in runs with $Cr(CO)_6$ and $Mn_2(CO)_{10}$ (runs 3, 4), generally more sulfur, Ramsbottom carbon residue, pentane insolubles and nitrogen was removed than in control run 1 (no additive). The preferred carbonyl, $Mn_2(CO)_{10}$, was also generally more effective in removing sulfur, pentane insolubles and nitrogen than $Mo(CO)_6$ (compare runs 2 and 4).

EXAMPLE III

An Arabian heavy crude (containing about 30 ppm nickel and 102 ppm vanadium) was hydrotreated with a molybdenum carboxylate in accordance with the procedure described in Example I. The LHSV of the oil was 1.0, the pressure was 2250 psig, hydrogen feed rate was 4,800 standard cubic feet hydrogen per barrel of oil, and the temperature was 765° F. (407° C.). The hydrofining catalyst was fresh, presulfided catalyst D.

In run 5, no molybdenum was added to the hydrocarbon feed. In run 6, molybdenum(IV) octoate was added for 19 days. Then molybdenum (IV) octoate, which had been heated at 635° F. for 4 hours in Monagas pipe line oil at a constant hydrogen pressure of 980 psig (without a catalyst) in a stirred autoclave, was added for 8 days. The results of run 5 are presented in Table IV and the results of run 6 in Table V. Both runs are outside the scope of this invention.

TABLE IV

| Days on stream | PPM Mo in Feed | (Run 5) PPM in Product Oil: Ni | V | Ni + V | % Removal of Ni + V |
|---|---|---|---|---|---|
| 1 | 0 | 13 | 25 | 38 | 71 |
| 2 | 0 | 14 | 30 | 44 | 67 |
| 3 | 0 | 14 | 30 | 44 | 67 |
| 6 | 0 | 15 | 30 | 45 | 66 |
| 7 | 0 | 15 | 30 | 45 | 66 |
| 9 | 0 | 14 | 28 | 42 | 68 |
| 10 | 0 | 14 | 27 | 41 | 69 |
| 11 | 0 | 14 | 27 | 41 | 69 |
| 13 | 0 | 14 | 28 | 42 | 68 |
| 14 | 0 | 13 | 26 | 39 | 70 |
| 15 | 0 | 14 | 28 | 42 | 68 |
| 16 | 0 | 15 | 28 | 43 | 67 |
| 19 | 0 | 13 | 28 | 41 | 69 |
| 20 | 0 | 17 | 33 | 50 | 62 |
| 21 | 0 | 14 | 28 | 42 | 68 |
| 22 | 0 | 14 | 29 | 43 | 67 |
| 23 | 0 | 14 | 28 | 42 | 68 |
| 25 | 0 | 13 | 26 | 39 | 70 |
| 26 | 0 | 9 | 19 | 28 | 79 |
| 27 | 0 | 14 | 27 | 41 | 69 |
| 29 | 0 | 13 | 26 | 39 | 70 |
| 30 | 0 | 15 | 28 | 43 | 67 |
| 31 | 0 | 15 | 28 | 43 | 67 |
| 32 | 0 | 15 | 27 | 42 | 68 |

TABLE V

| Days on Stream | PPM Mo in Feed | (Run 6) PPM in Product Oil: Ni | V | Ni + V | % Removal of Ni + V |
|---|---|---|---|---|---|
| | | Mo (IV) octoate as Mo source | | | |
| 3 | 23 | 16 | 29 | 45 | 66 |
| 4 | 23 | 16 | 28 | 44 | 67 |
| 7 | 23 | 13 | 25 | 38 | 71 |

TABLE V-continued

| Days on Stream | PPM Mo in Feed | (Run 6) PPM in Product Oil Ni | V | Ni + V | % Removal of Ni + V |
|---|---|---|---|---|---|
| 8 | 23 | 14 | 27 | 41 | 69 |
| 10 | 23 | 15 | 29 | 44 | 67 |
| 12 | 23 | 15 | 26 | 41 | 69 |
| 14 | 23 | 15 | 27 | 42 | 68 |
| 16 | 23 | 15 | 29 | 44 | 67 |
| 17 | 23 | 16 | 28 | 44 | 67 |
| 20 | Changed to hydro-treated Mo (IV) octate | | | | |
| 22 | 23 | 16 | 28 | 44 | 67 |
| 24 | 23 | 17 | 30 | 47 | 64 |
| 26 | 23 | 16 | 26 | 42 | 68 |
| 28 | 23 | 16 | 28 | 44 | 67 |

Referring now to Tables IV and V, it can be seen that the percent removal of nickel plus vanadium remained fairly constant. No improvement was seen when untreated or hydro-treated molybdenum octoate was introduced in run 3. This demonstrates that not all decomposable Group VI B metal compounds provide a beneficial effect in hydrofining operations.

EXAMPLE IV

This example illustrates the rejuventation of a substantially deactivated sulfided, promoted desulfurization catalyst (referred to as catalyst D in Table I) by the addition of a decomposable Mo compound to the feed, essentially in accordance with Example I except that the amount of Catalyst D was 10 cc. The feed was a supercritical Monagas oil extract containing about 29–35 ppm Ni, about 103–113 ppm V, about 3.0–3.2 weight-% S and about 5.0 weight-% Ramsbottom C. LHSV of the feed was about 5.0 cc/cc catalyst/hr; the pressure was about 2250 psig; the hydrogen feed rate was about 1000 SCF $H_2$ per barrel of oil; and the reactor temperature was about 775° F. (413° C.). During the first 600 hours on stream, essentially no Mo was present in the feed; thereafter about 68 ppm Mo as $Mo(CO)_6$ was added. Results of this run (Run 7) are summarized in Table VI.

Data in Table VI show that the demetallization activity of a substantially deactivated catalyst (removal of Ni+V after 586 hours: 21%) was dramatically increased (to about 87% removal of Ni+V) by Mo addition four about 120 hours. At the time when the Mo addition commenced, the deactivated catalyst had a metal (Ni+V) loading of about 34 weight-% (i.e., the weight of the fresh catalyst had increased by 34% due to the accumulation of metals). At the conclusion of the test run, the metal (Ni+V) loading was about 44 weight-%. Sulfur removal was not significantly affected by the addition of Mo. Based on these results, it is believed that the addition of $Cr(CO)_6$ and $Mn_2(CO)_{10}$ to the feed would also be beneficial in enhancing the demetallization activity of substantially deactivated catalysts.

TABLE VI

| Hours on Stream | Run 7 (Control) Feed Added Mo (ppm) | Ni (ppm) | V (ppm) | (Ni + V) (ppm) | Product Ni (ppm) | V (ppm) | (ni + V) (ppm) | % Removal of (Ni + V) |
|---|---|---|---|---|---|---|---|---|
| 46 | 0 | 35 | 110 | 145 | 7 | 22 | 29 | 80 |
| 94 | 0 | 35 | 110 | 145 | 8 | 27 | 35 | 76 |
| 118 | 0 | 35 | 110 | 145 | 10 | 32 | 42 | 71 |
| 166 | 0 | 35 | 110 | 145 | 12 | 39 | 51 | 65 |
| 190 | 0 | 32 | 113 | 145 | 14 | 46 | 60 | 59 |
| 238 | 0 | 32 | 113 | 145 | 17 | 60 | 77 | 47 |
| 299 | 0 | 32 | 113 | 145 | 22 | 79 | 101 | 30 |
| 377 | 0 | 32 | 113 | 145 | 20 | 72 | 92 | 37 |
| 430 | 0 | 32 | 113 | 145 | 21 | 74 | 95 | 34 |
| 556 | 0 | 29 | 108 | 137 | 23 | 82 | 105 | 23 |
| 586 | 0 | 29 | 108 | 137 | 24 | 84 | 108 | 21 |
| 646 | 68 | 29 | 103 | 132 | 22 | 72 | 94 | 29 |
| 676 | 68 | 29 | 103 | 132 | 20 | 70 | 90 | 32 |
| 682 | 117 | 28 | 101 | 129 | 18 | 62 | 80 | 38 |
| 706 | 117 | 28 | 101 | 129 | 16 | 56 | 72 | 44 |
| 712 | 117 | 28 | 101 | 129 | 16 | 50 | 66 | 49 |
| 736 | 117 | 28 | 101 | 129 | 9 | 27 | 36 | 72 |
| 742 | 117 | 28 | 101 | 129 | 7 | 22 | 29 | 78 |
| 766 | 117 | 28 | 101 | 129 | 5 | 12 | 17 | 87 |

EXAMPLE V

A topped (400° F.+) Hondo Californian crude was hydrotreated essentially in accordance with the procedure described in Example I, with the exception of the presulfiding of catalyst D. Catalyst D used in the two control runs of this example was presulfided as follows: heated under nitrogen to 400° F. during a 1 hour period; then heated with a mixture of $H_2$ (10 1/hr) and $H_2S$ (1.4 1/hr) at about 400° F. for a period of 2 hours per 5 cc catalyst; further heated to about 700° F.; subsequently heated with $H_2/H_2S$ at 700° F. for a period of 20 minutes per 5 cc catalyst; then cooled in $H_2/H_2S$ for 4 hours; and finally purged with $N_2$ while being cooled to room temperature. The managanese additive in run 9 was methycyclopentadienyl manganese tricarbonyl, $CH_3C_5H_4Mn(CO)_3$ (supplied by Pressure Chemical Company). In run 8 no Mn compound was added. LHSV was about 1.5 cc/hr/cc; the temperature was about 750° F.; the pressure was about 2,250 psig; and the hydrogen feed rate was about 4,800 SCF. Results are summarized in Table VII.

TABLE VII

| Run | Hours on Stream | Feed Added Mn (ppm) | Feed Ni (ppm) | Feed V (ppm) | Feed (Ni + V) (ppm) | Product Ni (ppm) | Product V (ppm) | Product (Ni + V) (ppm) | % Removal of (NI + V) |
|---|---|---|---|---|---|---|---|---|---|
| 8 | | | | | | | | | |
| (Control) | 65 | 0 | 110 | 251 | 361 | 26 | 39 | 65 | 82 |
| | 149 | 0 | 110 | 251 | 361 | 31 | 48 | 79 | 78 |
| | 197 | 0 | 110 | 251 | 361 | 29 | 47 | 76 | 79 |
| | 317 | 0 | 110 | 251 | 361 | 30 | 52 | 82 | 77 |
| | 367 | 0 | 110 | 254 | 365 | 31 | 53 | 84 | 77 |
| 9 | | | | | | | | | |
| (Control) | 22 | 25[1] | 110 | 250 | 360 | 37 | 63 | 100 | 72 |
| | 70 | 25 | 110 | 250 | 360 | 32 | 51 | 82 | 77 |
| | 94 | 25 | 110 | 250 | 360 | 33 | 57 | 90 | 75 |
| | 118 | 25 | 110 | 250 | 360 | 32 | 53 | 85 | 76 |
| | 142 | 25 | 110 | 250 | 360 | 32 | 53 | 85 | 76 |

[1]added as methylcyclopentadienyl manganese tricarbonyl.

Data in Table VII show no demetallization advantage of the addition of methylcyclopentadienyl manganese tricarbonyl to the feed. Also, in terms of the removal of sulfur, Ramsbottom carbon residue, nitrogen and pentane insoluble, no advantage was realized when the above-cited manganese compound was added. Based on these results, it is believed that among the zero-valent manganese compounds only $Mn_2(CO)_{10}$ is an effective hydrofining agent for heavy oils. These results also tend to support the belief that among zero-valent chromium compounds only $Cr(CO)_6$ is an effective hydrofining agent for heavy oils.

Reasonable variations and modifications are possible within the scope of the disclosure and the appended claims to the invention.

That which is claimed is:

1. A process for hydrofining a hydrocarbon-containing feed stream which contains metals comprising the steps of:

introducing a decomposable compound selected from the group consisting of dimanganese decacarbonyl and chromium hexacarbonyl into sand hydrocarbon-containing feed stream, wherein a sufficient quantity of said decomposable compound is added to said hydrocarbon-containing feed stream to result in a concentration of manganese and/or chromium in said hydrocarbon-containing feed stream in the range of about 1 to about 60 ppm; and contacting said hydrocarbon-containing feed stream containing said decomposable compound under hydrofining conditions with hydrogen and a catalyst composition comprising a support selected from the group consisting of alumina, silica and silica-alumina and a promoter comprising at least one metal selected from Group VIB, Group VIIB and Group VIII of the Periodic Table.

2. A process in accordance with claim 1 wherein said decomposable compound is dimanganese decacarbonyl.

3. A process in accordance with claim 1 wherein said decomposable compound is chromium hexacarbonyl.

4. A process in accordance with claim 1 wherein said catalyst composition comprises alumina, cobalt and molybdenum.

5. A process in accordance with claim 4 wherein said catalyst composition additionally comprises nickel.

6. A process in accordance with claim 1 wherein a sufficient quantity of said decomposable compound is added to said hydrocarbon-containing feed stream to result in a concentration of manganese and/or chromium in said hydrocarbon-containing feed stream in the range of about 2 to about 30 ppm.

7. A process in accordance with claim 1 wherein said hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

8. A process in accordance with claim 1 wherein said hydrofining conditions comprise a reaction time between said catalyst composition and said hydrocarbon-containing feed stream in the range of about 0.3 hours to about 5 hours, a temperature in the range of 340° C. to about 440° C., a pressure in the range of about 500 to about 3,000 psig and a hydrogen flow rate in the range of about 1,000 to about 6,000 standard cubic feet per barrel of said hydrocarbon-containing feed stream.

9. A process in accordance with claim 1 wherein the adding of said decomposable compound to said hydrocarbon-containing feed stream is interrupted periodically.

10. A process in accordance with claim 1 wherein said hydrofining process is a demetallization process.

11. A process in accordance with claim 10 wherein said metals are nickel and vanadium.

12. In a hydrofining process in which a hydrocarbon-containing feed stream which contains metals is contacted under hydrofining conditions with hydrogen and a catalyst composition comprising a support selected from the group comprising alumina, silica and silica-alumina and a promoter comprising at least one metal selected from Group VIB, Group VIIB, and Group VIII of the periodic table and in which said catalyst composition for said hydrofining process comprising the step of adding a decomposable compound selected from the group consisting of dimanganese decacarbonyl and chromium hexacarbonyl to said hydrocarbon-containing feed stream under mixing conditions prior to contacting said hydrocarbon-containing feed stream with said catalyst composition, wherein a sufficient quantity of said decomposable compound is added to said hydrocarbon-containing feed stream to result in a concentration of manganese and/or chromium in said hydrocarbon-containing feed stream in the range of about 1 to about 60 ppm and wherein said decomposable compund was not added to said hydrocarbon-containing feed stream during the period of time that said catalyst composition was at least partially deactivated by said use in said hydrofining process.

13. A process in accordance with claim 12 wherein said decomposable compound is dimanganese decacarbonyl.

14. A process in accordance with claim 12 wherein said decomposable compound is chromium hexacarbonyl.

15. A process in accordance with claim 12 wherein said catalyst composition is a spent catalyst composition due to use in said hydrofining process.

16. A process in accordance with claim 12 wherein said catalyst composition comprises alumina, cobalt and molybdenum.

17. A process in accordance with claim 16 wherein said catalyst composition additionally comprises nickel.

18. A process in accordance with claim 12 wherein a sufficient quantity of said decomposable compound is added to said hydrocarbon-containing feed stream to result in a concentration of manganese and/or chromium in said hydrocarbon-containing feed stream in the range of about 2 to about 30 ppm.

19. A process in accordance with claim 12 wherein said hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

20. A process in accordance with claim 12 wherein said hydrofining conditions comprise a reaction time between said catalyst composition and said hydrocarbon-containing feed stream in the range of about 0.3 hours to about 5 hours, a temperature in the range of 340° C. to about 440° C., a pressure in the range of about 500 to about 3,000 psig and a hydrogen flow rate in the range of about 1,000 to about 6,000 standard cubic feet per barrel of said hydrocarbon-containing feed stream.

21. A process in accordance with claim 12 wherein the adding of said decomposable compound to said hydrocarbon-containing feed stream is interrupted periodically.

22. A process in accordance with claim 12 wherein said hydrofining process is a demetallization process and wherein said metals are nickel and vanadium.

* * * * *